US008616665B2

(12) United States Patent
Czach et al.

(10) Patent No.: US 8,616,665 B2
(45) Date of Patent: Dec. 31, 2013

(54) DOOR BIN FOR A DOMESTIC REFRIGERATOR

(75) Inventors: Matthew G. Czach, Kalamazoo, MI (US); Matthew E. Herr, Evansville, IN (US); Scott E. Roales, Wadesville, IN (US); Michael S. Seeley, South Haven, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 73 days.

(21) Appl. No.: 13/114,319

(22) Filed: May 24, 2011

(65) Prior Publication Data

US 2012/0297816 A1 Nov. 29, 2012

(51) Int. Cl.
*A47B 96/04* (2006.01)

(52) U.S. Cl.
USPC ..... 312/405.1; 312/404

(58) Field of Classification Search
USPC ..... 312/321.5, 404, 405, 405.1, 408, 348.1, 312/348.4; 211/134–153
See application file for complete search history.

(56) References Cited

U.S. PATENT DOCUMENTS

| | | | | |
|---|---|---|---|---|
| 2,000,944 | A | 5/1935 | Gilbert et al. | |
| 2,898,173 | A | 8/1959 | Squire | |
| 3,029,953 | A | 4/1962 | Morrissey, Jr | |
| 3,227,502 | A | 1/1966 | Roberts | |
| 3,512,652 | A * | 5/1970 | Armstrong | 211/134 |
| 3,610,174 | A | 10/1971 | Kesling | |
| 3,709,576 | A | 1/1973 | Lemoine | |
| 4,449,761 | A * | 5/1984 | Davis et al. | 312/116 |
| 4,500,147 | A | 2/1985 | Reister | |
| 4,624,509 | A * | 11/1986 | Ramsey | 312/234.5 |
| 4,801,182 | A | 1/1989 | Metcalfe et al. | |
| 4,867,512 | A | 9/1989 | Wilkins et al. | |
| 5,004,305 | A | 4/1991 | Montuoro et al. | |
| 5,042,398 | A | 8/1991 | Lau et al. | |
| 5,228,764 | A * | 7/1993 | Cherry et al. | 312/408 |
| 5,346,299 | A | 9/1994 | Werkmeister et al. | |
| 5,370,455 | A | 12/1994 | Sedovic et al. | |
| 5,375,924 | A | 12/1994 | Pohl et al. | |
| 5,437,503 | A * | 8/1995 | Baker et al. | 312/404 |
| 5,733,022 | A * | 3/1998 | Whetstone | 312/140.4 |
| 5,951,134 | A | 9/1999 | Braun et al. | |
| 6,231,146 | B1 | 5/2001 | Dang | |
| 6,571,498 | B1 * | 6/2003 | Cyrluk | 40/661.03 |
| 6,582,038 | B2 | 6/2003 | Moreno-Olguin et al. | |
| D490,091 | S | 5/2004 | Quinlan | |
| 6,799,818 | B2 | 10/2004 | Ahmed et al. | |
| D511,177 | S | 11/2005 | Jackovin et al. | |
| 6,997,526 | B2 | 2/2006 | Leimkuehler et al. | |
| 7,228,612 | B2 * | 6/2007 | Lyvers | 29/527.1 |
| 7,293,846 | B2 | 11/2007 | Collins et al. | |
| 7,472,974 | B2 | 1/2009 | Czach et al. | |
| 7,665,326 | B2 | 2/2010 | LeClear et al. | |
| 7,748,805 | B2 | 7/2010 | Lucas et al. | |
| 8,152,257 | B2 * | 4/2012 | Kim | 312/405.1 |
| 2007/0159041 | A1 * | 7/2007 | Lucas et al. | 312/408 |
| 2009/0188877 | A1 * | 7/2009 | Stewart | 211/71.01 |
| 2010/0126202 | A1 | 5/2010 | Flores et al. | |

* cited by examiner

*Primary Examiner* — Darnell Jayne
*Assistant Examiner* — Sasha T Varghese

(57) ABSTRACT

A door bin for a refrigerator includes a metallic main body, a first endcap positioned at a first side of the main body, a second endcap positioned at a second side of the main body, an upper rail connecting an upper front corner of the first endcap to an upper front corner of the second endcap, and a glass panel.

19 Claims, 5 Drawing Sheets

DOOR BIN FOR A DOMESTIC REFRIGERATOR

CROSS-REFERENCE TO RELATED U.S. PATENT APPLICATIONS

Cross-reference is made to co-pending U.S. Design patent application Ser. No. 29/392,580 entitled "Door Bin," which was filed on May 24, 2011, which is assigned to the same assignee as the present application and is hereby incorporated by reference.

TECHNICAL FIELD

The present disclosure relates generally to a domestic refrigerator and more particularly to door bins for a domestic refrigerator.

BACKGROUND

A domestic refrigerator is a device that is used to store food items in a home. Domestic refrigerators typically include crisper bins, refrigerator door bins, shelves, and other structures in which food items may be placed. Some food items stored in refrigerators may require special care or handling to ensure those food items are preserved for later use. Refrigerator door bins may be used to store frequently needed items, such as milk, juices, butter, condiments, etcetera.

SUMMARY

According to one aspect of the disclosure, a door bin for a domestic refrigerator includes a metallic main body, a first endcap positioned at a first side of the main body, a second endcap positioned at a second side of the main body, an upper rail connecting an upper front corner of the first endcap to an upper front corner of the second endcap, and a glass panel disposed inside a region defined by a lower front of the main body, the first endcap, the second endcap, and the upper rail. In some embodiments, the lower front of the main body may have an upward-facing longitudinal channel defined therein sized to receive the glass panel. In some embodiments, the upper rail may have a downward-facing longitudinal channel defined therein sized to receive the glass panel.

In some embodiments, the main body and the upper rail may be formed from extruded aluminum. Additionally, in some embodiments, the main body may have a support surface extending between the first side and the second side. The support surface may also have a plurality of longitudinal grooves formed therein.

In some embodiments, the main body may have a substantially planar bottom wall. Additionally, in some embodiments, the main body may be "L"-shaped. The main body may include a bottom wall and a rear wall extending upwardly from the bottom wall.

In some embodiments, the glass panel may be made from tempered glass. In some embodiments, the glass panel may be made from frosted glass.

In some embodiments, the door bin may include a plurality of fasteners securing the first endcap and the second endcap to the main body and the upper rail. In some embodiments, the first endcap and the second endcap may be configured to removably couple the door bin in one or more positions within a refrigerator door. In some embodiments, the first endcap and the second endcap may be configured to removably couple the door bin in one or more positions within a freezer door.

In some embodiments, the first endcap may include a first bin handle and the second endcap may include a second bin handle. Additionally, in some embodiments, the first endcap may include a first opening defined below the first bin handle, and the second endcap may include a second opening defined below the second bin handle.

According to another aspect, a refrigerator door bin includes a metallic main body. The main body includes a bottom wall having a front end and a rear end, a rear wall extending upwardly from the rear end of the bottom wall, and an upward-facing channel defined in the front end of the bottom wall. The refrigerator door bin also includes a first plastic endcap positioned on a first side of the main body and a second plastic endcap positioned on a second side of the main body. The first plastic endcap has a vertical channel defined therein, and the second plastic endcap also has a vertical channel defined therein. The refrigerator door bin further includes a metallic upper rail positioned between an upper front corner of the first plastic endcap and an upper front corner of the second plastic endcap. The upper rail has a downward-facing channel defined therein positioned above the upward-facing channel of the main body. A glass panel is positioned in the upward-facing channel of the main body and the downward-facing channel of the upper rail, the vertical channel of the first plastic endcap, and the vertical channel of the second plastic endcap.

In some embodiments, the bottom wall of the main body may have a plurality of grooves defined in a substantially planar upper surface. In some embodiments, the rear wall of the main body may have a plurality of grooves defined in a substantially planar side surface.

According to another aspect, a refrigerator door bin includes a main body formed of extruded aluminum. The main body includes a substantially planar wall and an upward-facing longitudinal channel defined in a front end of the planar wall. The refrigerator door bin also includes a first endcap secured to a first side of the main body, a second endcap secured to second side of the main body, and a rail secured to the upper front corner of the first endcap and to the upper front corner of the second endcap. The rail includes a downward-facing longitudinal channel and being formed of extruded aluminum. A tempered glass panel is positioned in the upward-facing longitudinal channel of the main body and the downward-facing longitudinal channel of the rail.

In some embodiments, the refrigerator door bin may include a plurality of screws securing the first endcap and the second endcap to the main body. Additionally, in some embodiments, the planar wall may have a plurality of grooves defined therein.

BRIEF DESCRIPTION OF THE DRAWINGS

The detailed description particularly refers to the following figures, in which.

DETAILED DESCRIPTION OF THE DRAWINGS

Figure 1:
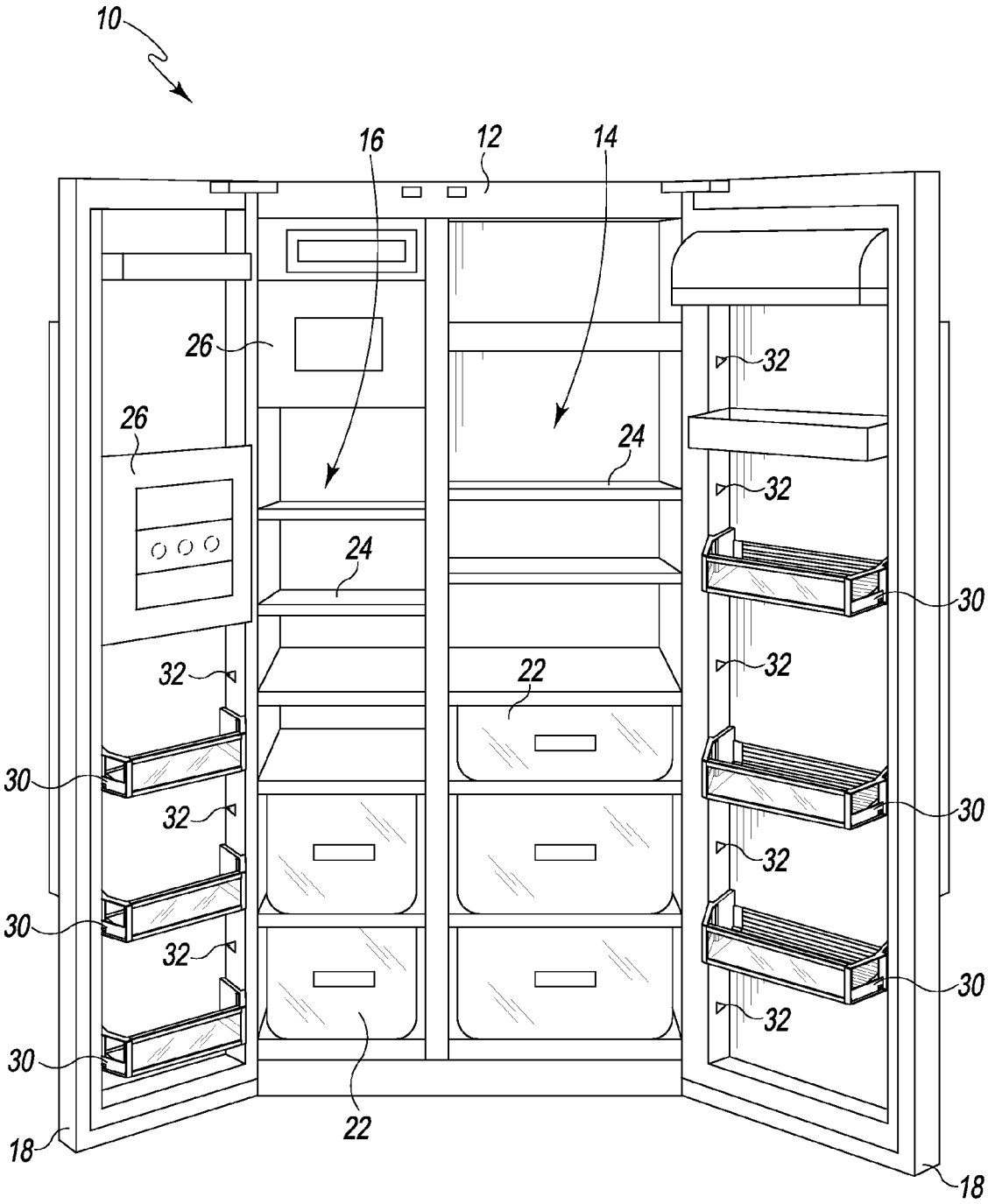
FIG. 1 is a front view of a domestic refrigerator showing a number of door bins positioned in the doors of the domestic refrigerator.

While the concepts of the present disclosure are susceptible to various modifications and alternative form, specific exemplary embodiments thereof have been shown by way of example in the drawings and will herein be described in detail. It should be understood, however, the concepts of the present disclosure are not limited to the particular forms described, but rather include all modifications, equivalents, and alternatives falling within the spirit and scope of the invention as defined by the appended claims.

Referring now to FIG. 1, an embodiment of a domestic refrigerator appliance 10 (hereinafter "refrigerator 10") is depicted. One example of a domestic refrigerator is the Jenn-Air Model JSC23W8EXS, which is commercially available from Whirlpool Corporation of Benton Harbor, Mich, U.S.A. The refrigerator 10 includes a housing 12, which defines a refrigerator compartment 14 and a freezer compartment 16. A user may place and store food items, such as milk, cheese, meats, produce, etcetera, in the refrigerator compartment 14 and/or the freezer compartment 16. The refrigerator doors 18 are operatively coupled to the housing 12 and permit access to the refrigerator compartment 14 and the freezer compartment 16. The refrigerator compartment 14 is operable to maintain stored food items within a predefined range or ranges of temperatures. The freezer compartment 16 is operable to separately maintain stored food items within a predefined range or ranges of temperatures.

The refrigerator 10 includes a variety of drawers 22 and shelves 24, which are positioned within the refrigerator compartment 14 and the freezer compartment 16. The freezer compartment 16 also houses an ice-maker 26. It will be appreciated that in other embodiments the ice-maker may be housed within one of the refrigerator doors 18.

While in the exemplary embodiment the refrigerator 10 is a "side-by-side" model having the refrigerator compartment 14 on the right side of the housing 12 and the freezer compartment 16 on the left side of the housing 12, it should be appreciated that other configurations are contemplated, such as, for example, an over-under design with the refrigerator compartment 14 at the top of the housing 12 and the freezer compartment 16 at the bottom of the housing 12, or vice-versa. Additionally, it should be appreciated that more than one refrigerator door may permit access to, for example, the refrigerator compartment 14, or the freezer compartment 16. The refrigerator 10 may also include more than one refrigerator compartment 14 and/or more than one freezer compartment 16.

The refrigerator 10 also includes a plurality of door bins 30. The door bins 30 may be mounted using a "pin in bin" mounting system, which includes a plurality of refrigerator door pins 32 extending from the refrigerator door 18. Each door pin 32 is configured to engage a corresponding notch 34 (see FIG. 2) defined in the door bin 30. Each refrigerator door pin 32 provides vertical support to the door bin 30, and the engagement between the pin 32 and the notch 34 permits the door bin 30 to be removably mounted in a selected location within refrigerator doors 18.

Figure 2:
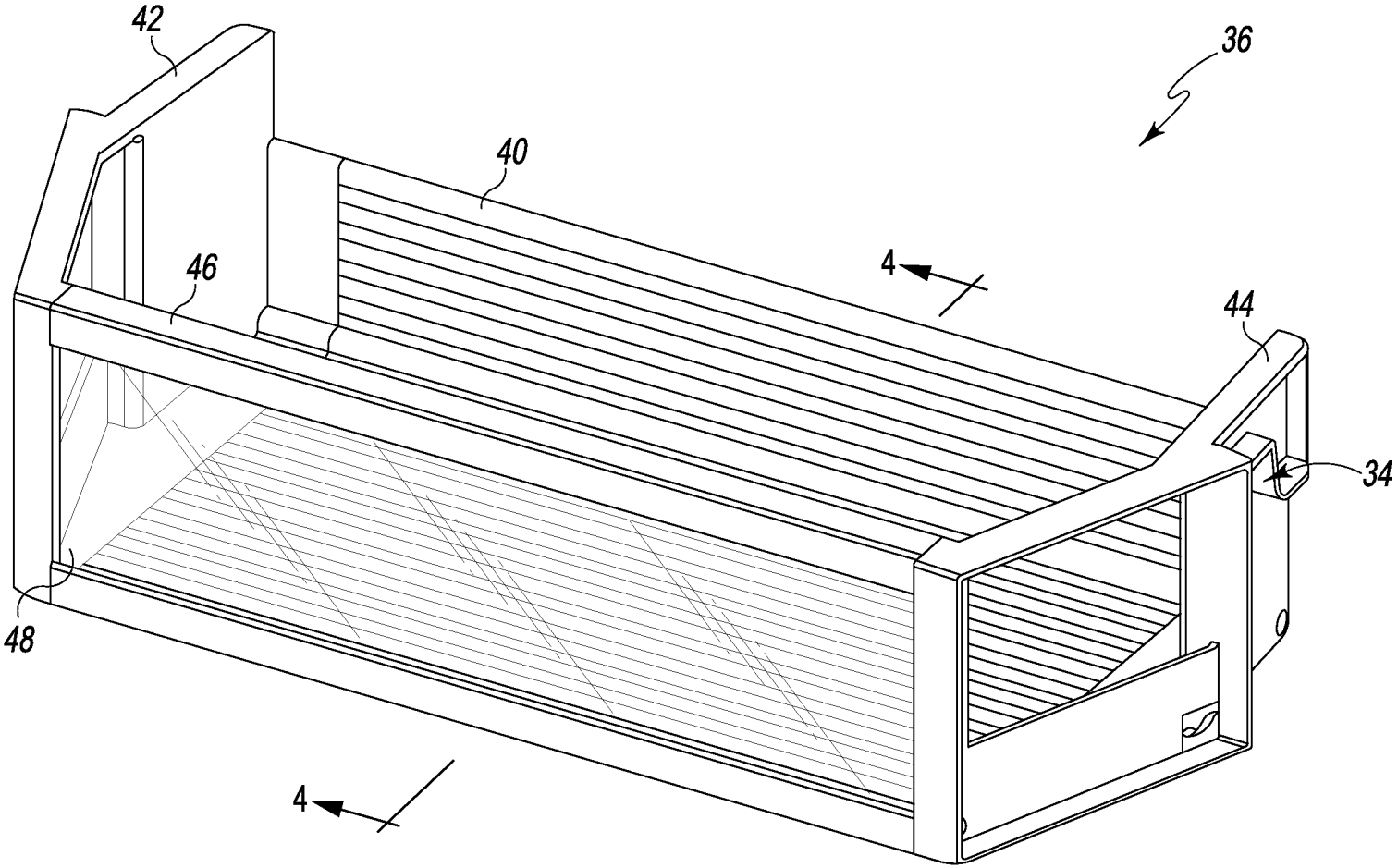
FIG. 2 is a front perspective view of one embodiment of a door bin for use in the refrigerator of FIG. 1.
Figure 3:
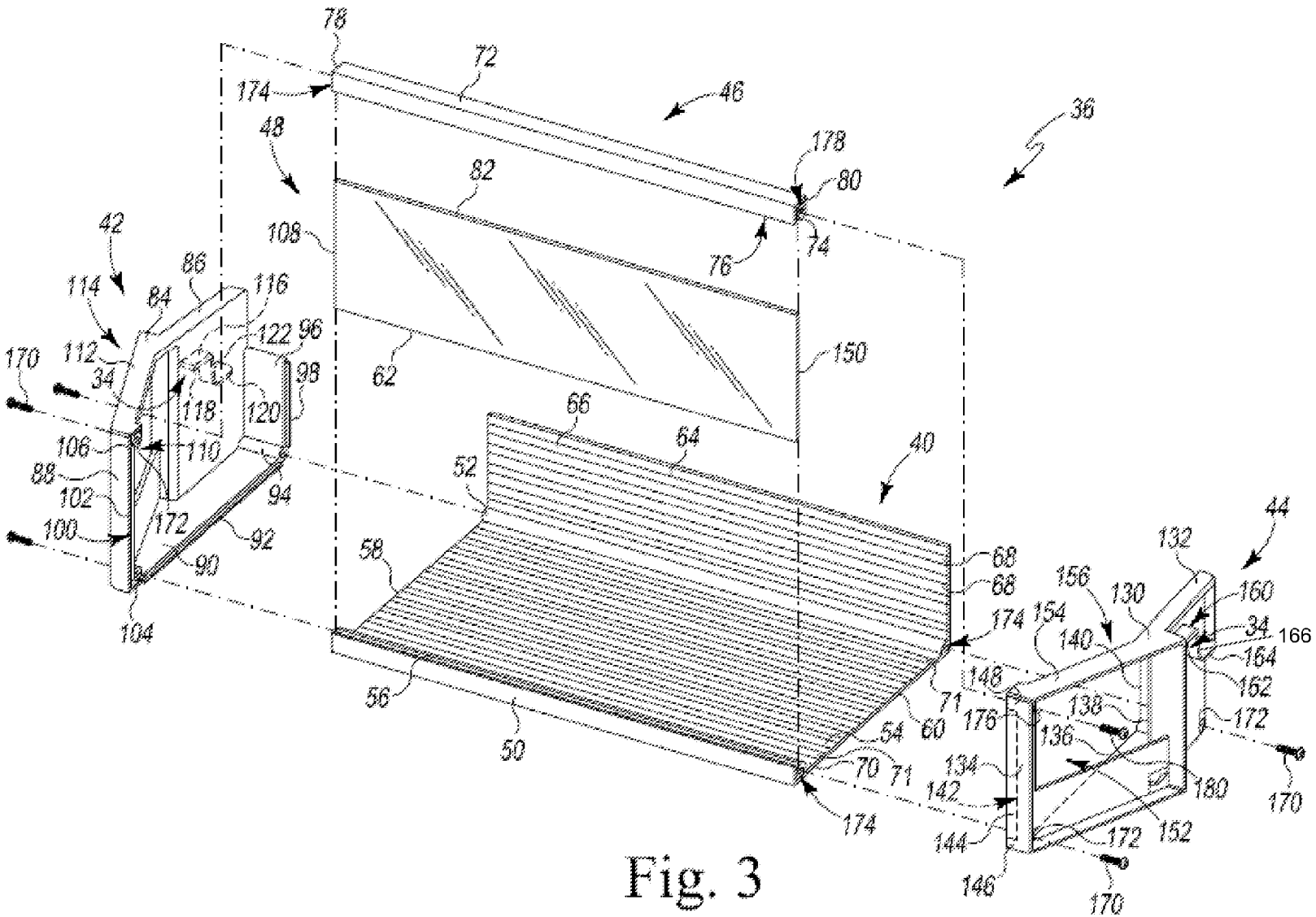
FIG. 3 is an exploded perspective view of the door bin of FIG. 2.

Referring now to FIGS. 2 and 3, one embodiment of the door bin 30 (hereinafter door bin 36) is shown. The door bin 36 includes a main body 40 and a pair of endcaps 42, 44 positioned on each side of the door bin 36. A rail 46 is positioned between the endcaps 42, 44. The door bin 36 also includes a glass panel 48.

The main body 40 includes a bottom wall 54 having a front edge piece 50 and a rear edge piece 52. As best seen in FIG. 3, the front edge piece 50 has an upwardly-facing channel 56 defined therein that extends from one side 58 of the main body 40 to the other side 60 of the main body 40. The channel 56 is sized to receive a lower edge 62 of the glass panel 48.

Figure 4:
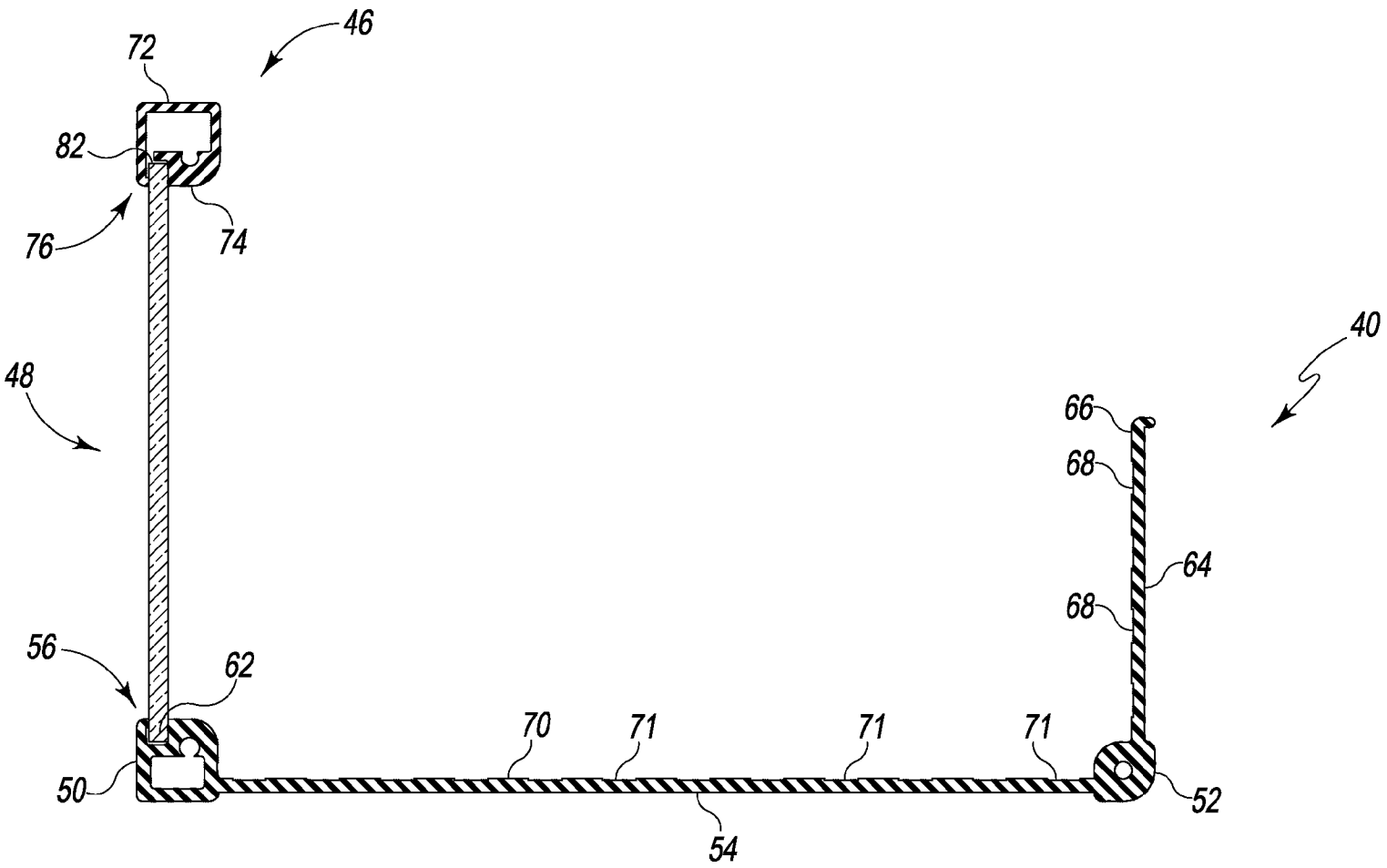
FIG. 4 is a cross-sectional view of the door bin of FIGS. 2 and 3 taken along the line 4-4 of FIG. 2.

The main body 40 also includes a rear wall 64 that extends upwardly from the rear edge piece 52. In that way, the main body 40 is "L"-shaped, with the bottom wall 54 defining the bottom of the door bin 36 and the rear wall 64 defining the back of the door bin 36. As best seen in FIG. 4, the bottom wall 54 has a depth that is greater than the height of the rear wall 64. It should be appreciated that in other embodiments the depth of the bottom wall 54 may be less than the height of the rear wall 64 such that the door bin is more narrow and/or taller than the door bin 36.

The rear wall 64 of the main body 40 has a substantially planar front surface 66. A plurality of grooves 68 are defined in the front surface 66, and each groove 68 extends from the side 58 to the side 60 of the main body 40. The bottom wall 54 of the main body 40 also has a substantially planar upper surface 70. Like the front surface 66 of the rear wall 64, a plurality of grooves 71 are defined in the upper surface 70, and each groove 71 extends from the side 58 to the side 60 of the main body 40. It should be appreciated that while one groove spacing is shown in the drawings, the grooves may be larger or smaller or arranged differently in other embodiments. It should also be appreciated that in other embodiments the surfaces 66, 70 may be smooth or may include a different texture.

The main body 40 is formed as a single monolithic component from extruded aluminum of sufficient strength to support food items placed in the door bin 36. It should be appreciated that in other embodiments the main body 40 may be formed from another metallic material, such as, for example, a steel or a metal alloy and may be fabricated by casting or die-casting, or other method. It should also be appreciated that the main body 40 may also have a decorative finish resembling brushed aluminum, brushed nickel, stainless steel finish, and so forth.

As discussed above, the door bin 36 also includes the rail 46, which is positioned above the front edge piece 50 of the main body 40. The rail 46 has a shell 72 that is formed from extruded aluminum. It should be appreciated that in other embodiments the rail 46, like the main body 40, may be formed from another metallic material, such as, for example, a steel or a metal alloy and may be fabricated by casting or die-casting, or other method. It should also be appreciated that the rail 46 may also have a decorative finish resembling brushed aluminum, brushed nickel, stainless steel finish, and so forth. The shell 72 includes a bottom surface 74, and the bottom surface 74 has a channel 76 defined therein that extends from one side 78 of the shell 72 to the other side 80 of the shell 72. The channel 76 is sized to receive an upper edge 82 of the glass panel 48.

The endcaps 42, 44 of the door bin 36 are positioned on the sides 58, 60 of the main body 40 and the sides 78, 80 of the rail 46. The endcap 42 includes a body 84 having a vertical sidewall 86 and another vertical sidewall 88 that is angled relative to the vertical sidewall 86. A bottom wall 90 extends inwardly from the sidewalls 86, 88. A flange 92 extends from the bottom wall 90, and the flange 92 is positioned below, and in contact with, the bottom wall 54 of the main body 40 when the door bin 36 is assembled.

The endcap 42 also includes a rear edge piece 94, which is connected to the bottom wall 90 and extends inwardly from the sidewall 86. A rear wall 96 extends inwardly from the sidewall 86 and upwardly from the rear edge piece 94. Like the bottom wall 90, the rear wall 96 has a flange 98 extending therefrom. The flange 98 is positioned behind, and in contact with the rear wall 64 of the main body 40 when the door bin 36 is assembled.

The sidewall 88 of the endcap 42 has a closed channel 100 positioned in its front edge 102. The channel 100 extends between a lower front corner 104 of the endcap 42 and an upper front corner 106 of the endcap 42. The channel 100 is sized to receive a side edge 108 of the glass panel 48.

An opening 110 is defined in the sidewall 88 of the endcap 42. As shown in FIGS. 2 and 3, the opening 110 is rectangular, but it should be appreciated that in other embodiments the opening 110 may be circular, oval, or other form. The section 112 of the sidewall 88 positioned above the opening 110 acts as a handle 114 for the door bin 36. The handle 114 is sized to receive the hand of a user to provide the user with the means to remove the door bin 36 from the refrigerator door 18.

The endcap 42 has a flange 116 extending outwardly from the sidewall 86. The flange 116 has an upper section 118 and a lower section 120. The sections 118, 120 extend substantially horizontally. A middle section 122 of the flange 116 extends between the upper section 118 and the lower section 120, and the middle section 122 is inclined. The upper section 118 and the middle section 122 cooperate to define the notch 34 that receives the pin 32 of the refrigerator door 18 to mount the door bin 36 to the refrigerator door 18.

The endcap 44 is a mirrored version of the endcap 42. As such, the endcap 44 has features similar to those discussed above in regard to endcap 44. The endcap 44 includes a body 130 having a vertical sidewall 132 and another vertical sidewall 134 that is angled relative to the vertical sidewall 132. A bottom wall 136 extends inwardly from the sidewalls 132, 134. A flange (not shown) extends from the bottom wall 136, and the flange is positioned below, and in contact with, the bottom wall 54 of the main body 40 when the door bin 36 is assembled.

The endcap 44 also includes a rear edge piece 138, which is connected to the bottom wall 136 and extends inwardly from the sidewall 132. A rear wall 140 extends inwardly from the sidewall 132 and upwardly from the rear edge piece 138. The rear wall 96 also has a flange (not shown) extending therefrom, and the flange is positioned behind, and in contact with the rear wall 140 of the main body 40 when the door bin 36 is assembled.

The sidewall 134 of the endcap 44 has a closed channel 142 positioned in its front edge 144. The channel 142 extends between a lower front corner 146 of the endcap 44 and an upper front corner 148 of the endcap 44. The channel 142 is sized to receive a side edge 150 of the glass panel 48.

An opening 152 is defined in the sidewall 134 of the endcap 44. As shown in FIGS. 2 and 3, the opening 152 is rectangular, but it should be appreciated that in other embodiments the opening 152 may be circular, oval, or other form. The section 154 of the sidewall 134 positioned above the opening 152 acts as another handle 156 for the door bin 36. The handle 156 is sized to receive the hand of a user to provide the user with the means to remove the door bin 36 from the refrigerator door 18.

The endcap 44 has a flange 160 extending outwardly from the sidewall 132. The flange 160 has an upper section 162 and a lower section 164. The sections 162, 164 extend substantially horizontally. A middle section 166 of the flange 160 extends between the upper section 162 and the lower section 164, and the middle section 166 is inclined. The upper section 162 and the middle section 166 cooperate to define another notch 34 that receives another pin 32 of the refrigerator door 18 to mount the door bin 36 to the refrigerator door 18.

The endcaps 42, 44 are formed from a plastic material, such as, for example, polyethylene. It should be appreciated that in other embodiments the endcaps 42, 44 may be formed from a metallic material, such as, for example, aluminum, steel or metal alloy and may be fabricated by extrusion, casting or die-casting, or other method. It should also be appreciated that the endcaps 42, 44 may also have a decorative finish resembling brushed aluminum, brushed nickel, stainless steel finish, and so forth.

A plurality of fasteners 170 secure the endcaps 42, 44 to the main body 40 and the rail 46. The fasteners 170 are illustratively embodied as screws, but it should be appreciated that in other embodiments the fasteners 170 may take the form of pegs, pins, dowels, or other joining members. The fasteners 170 extend through openings 172 defined in the endcaps 42, 44 and are threaded into corresponding holes 174 defined in the main body 40 and the rail 46. For example, the endcap 44 has an opening 176 defined through its upper front corner 148, and a corresponding threaded hole 178 is defined in the side 80 of the rail 46. A fastener, such as, for example, a screw 180, extends through the opening 176 and is threaded into the hole 178, thereby securing the rail 46 to the upper front corner 148 of the endcap 44. When the door bin 36 is assembled as shown in FIG. 2, the rail 46 connects the upper front corner 106 of the endcap 42 to the upper front corner 148 of the endcap 44. It will be appreciated that in other embodiments the endcaps 42, 44 may be secured to the main body 40 and the rail 46 via a friction fit or some combination of a friction fit and fasteners.

The door bin 36 also includes the glass panel 48. In the illustrative embodiment, the glass panel 48 is longer than the rail 46 and the main body 40 such that the edges 108, 150 of the glass panel 48 are positioned beyond the sides 58, 60 of the main body 40 and the sides 78, 80 of the rail 46. As discussed above, when the door bin 36 is assembled, the lower edge 62 of the glass panel 48 is received in the channel 56 of the main body 40 and the upper edge 82 of the glass panel 48 is received in the channel 76 defined in the rail 46. Similarly, the side edges 108, 150 of the glass panel 48 are positioned in the channels 100, 142 defined in the endcaps 42, 44, respectively. In that way, the glass panel 48 is disposed inside a region defined by the main body 40, the endcaps 42, 44, and the rail 46.

While in this embodiment, the glass panel 48 is depicted as a clear, tempered glass panel, it should be appreciated that in other embodiments the glass panel 48 may frosted or coated. The glass panel 48 may also be formed of any material that provides glass-like properties (e.g., glass, tempered glass, frosted glass, tempered glass with a fully- or partially-applied coating, etcetera).

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected. For example, while the handles 114, 156 are depicted as being formed within the endcaps 42, 44, respectively, in other embodiments the handles 114, 156 may also be attached as separate structures to door bin 36. The handles 114, 156 may be attached to door bin 36 using screws, a friction fit, adhesive, or an alternative type of fastener. It should also be appreciated that in other embodiments the handles 114, 156 may also be omitted. In another embodiment, the channels 100, 142 may be omitted from the endcaps 42, 44 and the glass panel 48 may have a length that substantially matches the length of the rail 46 and the main body 40 such that the glass panel 48 is positioned in a region defined by the channels 56, 76 of the main body 40 and the rail 46, respectively, and the sidewalls of the endcaps 42, 44.

Figure 5:
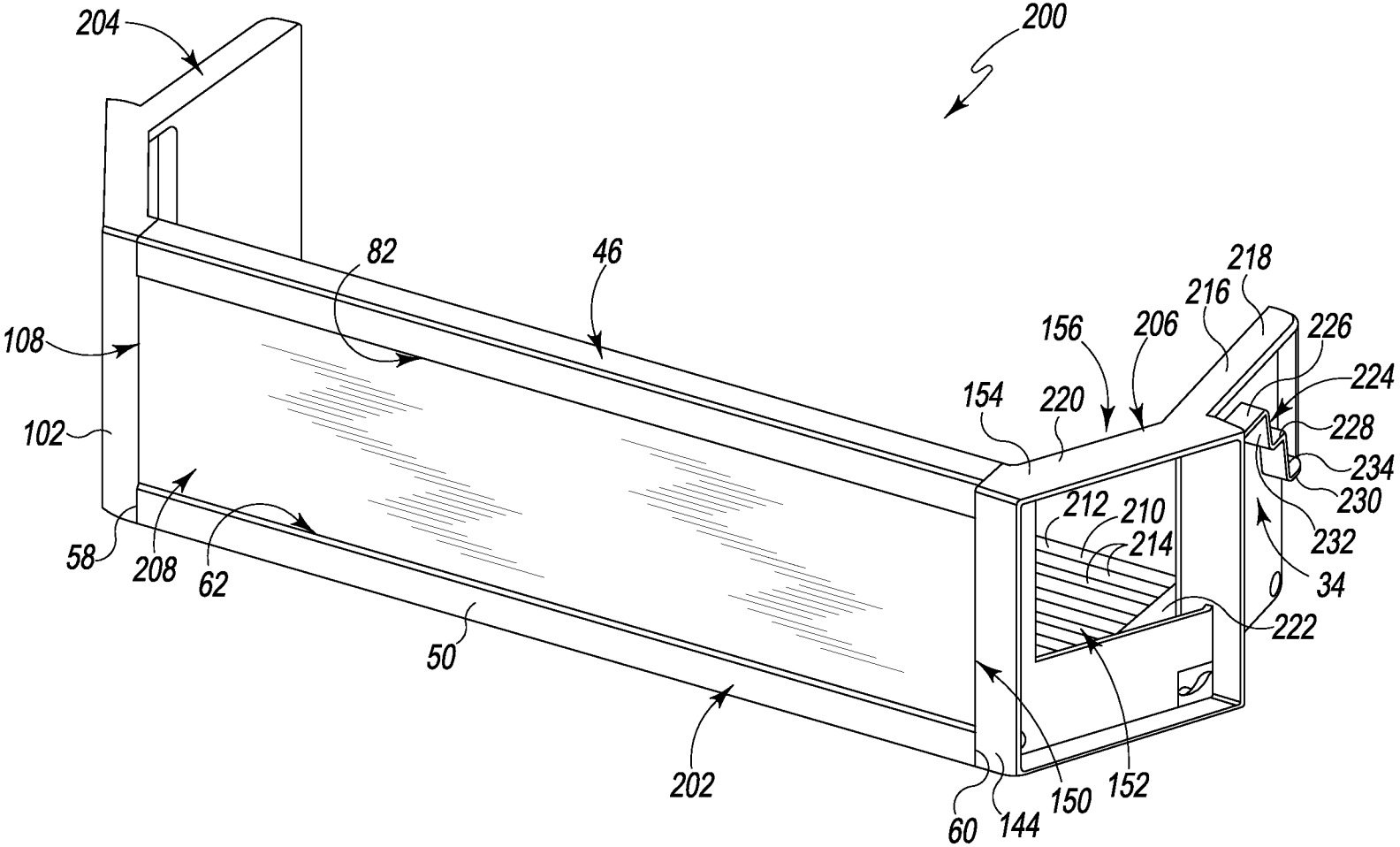
FIG. 5 is a front perspective view of another embodiment of a door bin for use in the refrigerator of FIG. 1.

Referring now to FIG. 5, another embodiment of a door bin (hereinafter referenced as a door bin 200) is shown. Some features of the embodiment illustrated in FIG. 5 are substantially similar to those discussed above in reference to the embodiment of FIGS. 2-4. Such features are designated in FIG. 5 with the same reference numbers as those used in FIGS. 2-4.

The door bin 200 includes a main body 202 and a pair of endcaps 204, 206 positioned on each side of the main body 202. A rail 46 is positioned between the endcaps 204, 206. The door bin 200 also includes a glass panel 208.

The main body 202 includes a bottom wall 210 having a front edge piece 50, and the front edge piece 50 has a channel 56 sized to receive a lower edge 62 of the glass panel 208. The bottom wall 210 of the main body 202 also has a substantially planar upper surface 212. A plurality of grooves 214 are defined in the upper surface 212. In contrast with the embodiment of FIGS. 2-4, the main body 202 lacks a rear wall such that the back of the door bin 200 is open.

The endcaps 204, 206 of the door bin 36 are positioned on the sides 58, 60 of the main body 202 and the sides 78, 80 of the rail 46, and the endcaps 204, 206 are mirrored versions of each other. The endcap 206 has a body 216 includes a vertical sidewall 218 and another vertical sidewall 220 that is angled relative to the vertical sidewall 218. A bottom wall 222 extends inwardly from the sidewalls 218, 220. The bottom wall 222 has a flange (not shown) extending therefrom that is positioned below, and in contact with, the bottom wall 210 of the main body 202 when the door bin 200 is assembled.

Like the sidewall 134 of the endcap 44, the endcap 206 has a closed channel (not shown) positioned in its front edge 144 that is sized to receive a side edge 150 of the glass panel 208. The endcap 206 also includes an opening 152 that is defined in the sidewall 220. The section 154 of the sidewall 220 positioned above the opening 152 acts as a handle 156 for the door bin 200. The handle 156 is sized to receive the hand of a user to provide the user with the means to remove the door bin 36 from the refrigerator door 18.

The endcap 206 has a flange 224 extending outwardly from the sidewall 218. The flange 224 has an upper section 226, a middle section 228, and a lower section 230. The sections 226, 228, 230 extend substantially horizontally. A connecting section 232 of the flange 224 extends between the upper section 226 and the middle section 228, and another connecting section 234 of the flange 224 extends between the middle section 228 and the lower section 230. The connecting sections 232, 234 are inclined. The sections 226, 228, 232, 234 cooperate to define the notch 34 that receives the pin 32 of the refrigerator door 18 to mount the door bin 200 to the refrigerator door 18.

As discussed above, the endcap 204 is a mirrored version of the endcap 206. As such, the endcap 204 has features similar to those discussed above in regard to endcap 206, including, for example, a closed channel (not shown) positioned in its front edge 102 that is sized to receive a side edge 108 of the glass panel 208.

The glass panel 208 of the door bin 200 is formed from frosted glass. As discussed above, when the door bin 200 is assembled, the lower edge 62 of the glass panel 208 is received in the channel 56 of the main body 202 and the upper edge 82 of the glass panel 48 is received in the channel 76 defined in the rail 46. Similarly, the side edges 108, 150 of the glass panel 48 are positioned in the channels defined in the endcaps 204, 206, respectively. In that way, the glass panel 208 is disposed inside a region defined by the main body 202, the endcaps 204, 206, and the rail 46.

As will be appreciated by those of skill in the art, the refrigerator 10 may include elements other than those shown and described above. In addition, there are a plurality of advantages of the present disclosure arising from the various features of the apparatus described herein. It will be noted that alternative embodiments of the apparatus of the present disclosure may not include all of the features described yet still benefit from at least some of the advantages of such features. Those of ordinary skill in the art may readily devise their own implementations of the apparatus that incorporate one or more of the features of the present invention and fall with in the spirit and scope of the present disclosure as defined by the appended claims.

The invention claimed is:

1. A door bin for a domestic refrigerator comprising:

an "L"-shaped metallic main body including a bottom wall and a rear wall extending upwardly from the bottom wall, wherein, at a lower front of the main body, the bottom wall has an upward-facing longitudinal channel defined therein sized to receive a panel, a first endcap positioned at a first side of the main body wherein, the first endcap includes a first vertical sidewall to removably couple the door bin in one or more positions within a door, a second endcap positioned at a second side of the main body, an upper rail connecting an upper front corner of the first endcap to an upper front corner of the second endcap, and a transparent panel disposed inside a region defined by the upward-facing longitudinal channel at the lower front of the main body, the first endcap, the second endcap, and the upper rail.

2. The door bin of claim 1, wherein the first endcap further includes a second sidewall that is angled relative to the first sidewall and has a handle and an opening defined through the second sidewall below the handle to receive a hand of a user.

3. The door bin of claim 2, wherein the upper rail has a downward-facing longitudinal channel defined therein sized to receive the transparent panel.

4. The door bin of claim 2, wherein the second endcap comprises:

a first vertical sidewall to removably couple the door bin in one or more positions within the door; and a second sidewall that is angled relative to the first sidewall of the second endcap and has a handle and an opening defined through the second sidewall below the handle to receive another hand of the user.

5. The door bin of claim 1, wherein the main body and the upper rail are formed from extruded aluminum.

6. The door bin of claim 1, wherein the main body has a support surface extending between the first side and the second side, the support surface having a plurality of longitudinal grooves defined therein.

7. The door bin of claim 1, wherein the bottom wall of the main body is substantially planar.

8. The door bin of claim 1, wherein the transparent panel is made from tempered glass.

9. The door bin of claim 1, wherein the transparent panel is made from frosted glass.

10. The door bin of claim 1 further comprising a plurality of fasteners securing the first endcap and the second endcap directly to each of the main body and the upper rail.

11. The door bin of claim 1, wherein the first endcap and the second endcap are configured to removably couple the door bin in one or more positions within the door.

12. The door bin of claim 1, wherein the first endcap and the second endcap are configured to removably couple the door bin in one or more positions within the door, wherein the door is a freezer door.

13. A refrigerator door bin comprising:

an "L"-shaped metallic main body including (i) a bottom wall having a front end and a rear end, (ii) a rear wall extending upwardly from the rear end of the bottom wall, and (iii) an upward-facing channel defined in the front end of the bottom wall, a first plastic endcap positioned on a first side of the main body, the first plastic endcap having a vertical channel defined therein, a second plastic endcap positioned on a second side of the main body, the second plastic endcap having a vertical channel defined therein, a metallic upper rail positioned between an upper front corner of the first plastic endcap and an upper front corner of the second plastic endcap, the upper rail having a downward-facing channel defined therein positioned above the upward-facing channel of the main body, and a transparent panel positioned in the upward-facing channel of the main body and the downward-facing channel of the upper rail, the vertical channel of the first plastic endcap, and the vertical channel of the second plastic endcap.

14. The refrigerator door bin of claim 13, wherein the first endcap includes a first opening defined below a first bin handle, and the second endcap includes a second opening defined below a second bin handle, with portions of the first and second endcaps located above the first and second openings establishing the first and second bin handles and the first and second openings enabling hands of a user to access the first and second bin handles.

15. The refrigerator door bin of claim 13, wherein the bottom wall of the main body has a plurality of grooves defined in a substantially planar upper surface thereof.

16. The refrigerator door bin of claim 13, wherein the rear wall of the main body has a plurality of grooves defined in a substantially planar side surface thereof.

17. A refrigerator door bin comprising:

a main body formed of extruded aluminum, the main body including a substantially planar wall and an upward-facing longitudinal channel defined in a front end of the planar wall, a rear wall extending upwardly from a rear end of the planar wall, a first endcap secured to a first side of the main body, the first endcap including a first vertical sidewall to removably couple the door bin in one or more positions within a door, and a second vertical sidewall that is angled relative to the first vertical sidewall, the second vertical sidewall having a handle and an opening defined through the second vertical sidewall below the handle to receive a hand of a user, a second endcap secured to a second side of the main body, a rail secured to an upper front corner of the first endcap and to an upper front corner of the second endcap, the rail including a downward-facing longitudinal channel and being formed of extruded aluminum, and a transparent panel positioned in the upward-facing longitudinal channel of the main body and the downward-facing longitudinal channel of the rail.

18. The refrigerator door bin of claim 17, further comprising a plurality of screws securing the first endcap and the second endcap directly to both the main body and the rail.

19. The refrigerator door bin of claim 17, wherein the planar wall has a plurality of grooves defined therein.

* * * * *